US007399934B2

(12) United States Patent
Emura et al.

(10) Patent No.: US 7,399,934 B2
(45) Date of Patent: Jul. 15, 2008

(54) EXTERNAL OPERATION HANDLE DEVICE

(75) Inventors: Takeshi Emura, Kounosu (JP); Makoto Osawa, Otawara (JP); Hideki Ishido, Otawara (JP)

(73) Assignee: Fuji Electric PA Components & Systems Co., Ltd, Tokyo (JP)

( * ) Notice: Subject to any disclaimer, the term of this patent is extended or adjusted under 35 U.S.C. 154(b) by 0 days.

(21) Appl. No.: 11/898,545

(22) Filed: Sep. 13, 2007

(65) Prior Publication Data

US 2008/0073188 A1 Mar. 27, 2008

(30) Foreign Application Priority Data

Sep. 21, 2006 (JP) ..... 2006-255923

(51) Int. Cl.
*H01H 9/20* (2006.01)

(52) U.S. Cl. ..... 200/50.12; 200/43.11

(58) Field of Classification Search ..... 200/43.01, 200/43.11, 43.13–43.16, 43.19, 43.21, 50.03, 200/50.05, 50.06, 50.12, 318.1, 321–325, 200/329–331, 334, 336
See application file for complete search history.

(56) References Cited

U.S. PATENT DOCUMENTS 2,849,555 A * 5/1958 Cellerini ..... 200/50.06
5,243,157 A * 9/1993 Hoffman ..... 200/43.11
5,302,925 A * 4/1994 Castonguay et al. ..... 335/17
5,477,016 A * 12/1995 Baginski et al. ..... 200/43.11
5,902,973 A * 5/1999 Ramey et al. ..... 200/50.01
5,998,743 A * 12/1999 Unkel ..... 200/43.11
6,423,912 B1 * 7/2002 Arenz et al. ..... 200/43.08
6,518,526 B2 * 2/2003 Hamada et al. ..... 200/330
6,797,903 B1 * 9/2004 Winslett et al. ..... 200/331
6,949,711 B1 * 9/2005 Litteer ..... 200/43.01
6,974,922 B2 * 12/2005 Bortolloni et al. ..... 200/50.06
7,227,092 B2 * 6/2007 Low et al. ..... 200/43.14

FOREIGN PATENT DOCUMENTS

| | | |
|---|---|---|
| JP | H05-067423 | 3/1993 |
| JP | H09-312119 | 12/1997 |
| JP | 2002-025411 | 1/2002 |
| JP | 2005-149918 | 6/2005 |

* cited by examiner

*Primary Examiner*—Michael A Friedhofer
(74) *Attorney, Agent, or Firm*—Manabu Kanesaka

(57) ABSTRACT

An external operation handle device for a circuit breaker includes a rotary handle equipped with a handle lock lever, a drive mechanism linking the rotary handle and the locker handle of the circuit breaker, and a door lock lever for interlocking between the rotary handle and a door of the board. By operating the rotary handle, the circuit breaker can be turned to an ON or OFF position, and the door is unlocked at an OPEN position. The handle lock lever is slidably disposed on the rotary handle to be anchored and held at a pulled out position in a condition where the rotary handle at the OPEN position unlocks the door of the board, and the door lock lever linked to the rotary handle is cramped and held at the unlock position in a condition where the rotary handle is at the OPEN position.

5 Claims, 7 Drawing Sheets

Fig. 3(a)
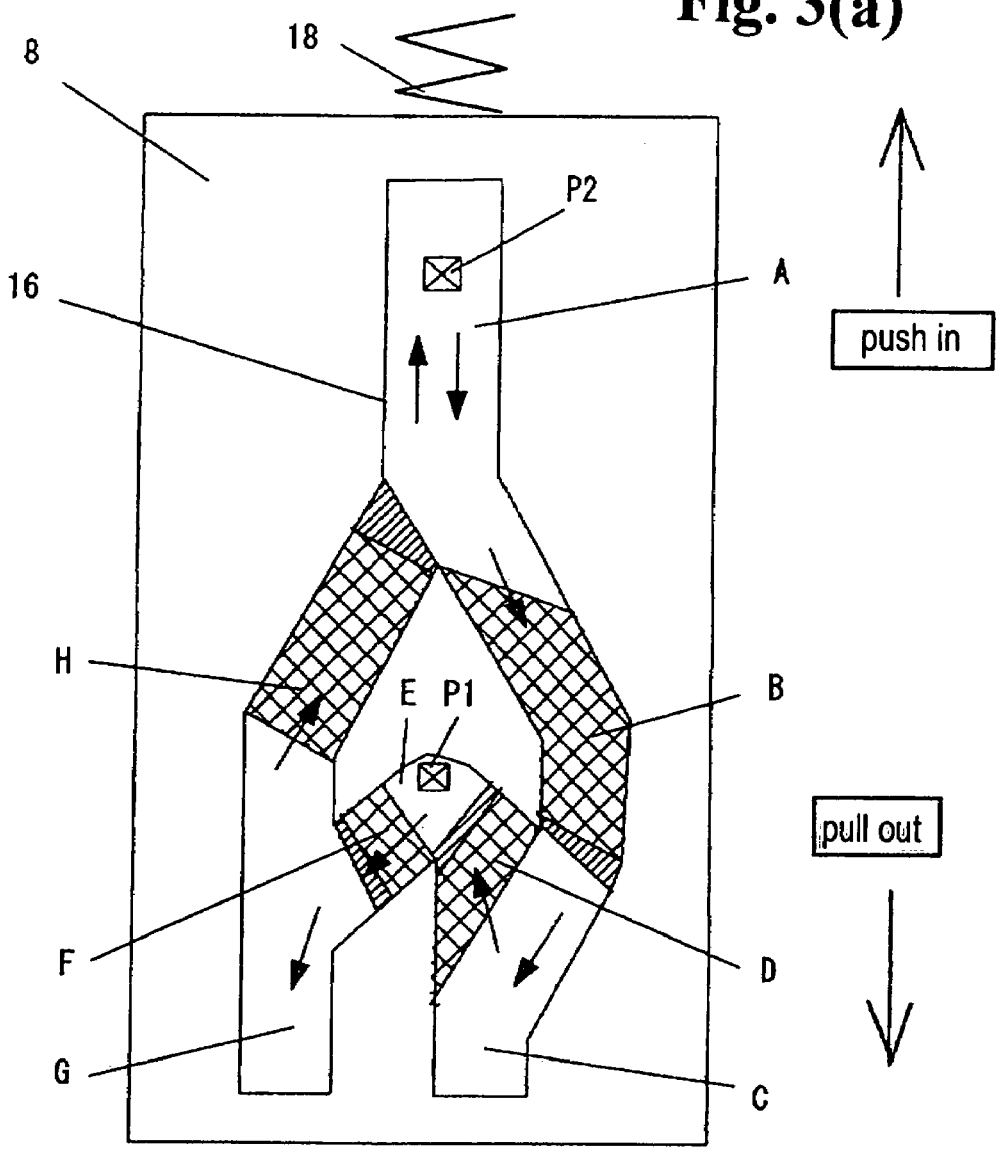
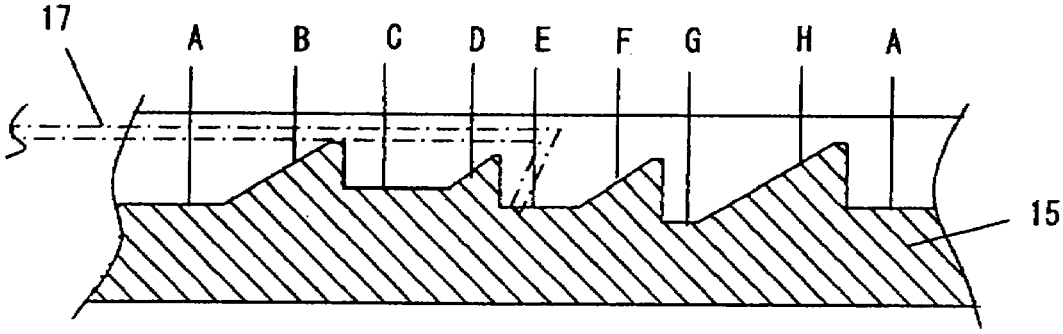
Fig. 3(b)

EXTERNAL OPERATION HANDLE DEVICE

BACKGROUND OF THE INVENTION AND RELATED ART STATEMENT

The present invention relates to an external operation handle device used in circuit breakers, for example, a molded case circuit breaker, an earth leakage breaker, and the like.

An external operation handle device, an accessory device for a molded case circuit breaker, an earth leakage breaker, and the like, is known (for example, Patent Document 1: Japanese Unexamined Patent Application Publication No. 2005-149918), which operates a circuit breaker disposed inside a switch board, a control board, or the like, for open and close operations of the circuit breaker from outside of the board.

The external operation handle device has a rotary handle and a drive mechanism mounted on a mounting base, the drive mechanism linking the rotary handle and a locker handle of the circuit breaker. The external operation handle device assembled with the circuit breaker disposed inside the board is operated by rotating the rotary handle from outside the board to drive the rotary handle of the circuit breaker to ON or OFF position.

A type of an external operation handle device having a door lock mechanism is known (for example, Patent Document 2: Japanese Unexamined Patent Application Publication No. H5-67423), in which an interlock mechanism is provided between the rotary handle and the door panel of the board to lock the door panel at a closed position in normal conditions, preventing the door from being opened accidentally.

Another type of an external operation handle device having a handle lock mechanism is known (for example, Patent Document 3: Japanese Unexamined Patent Application Publication No. 2002-25411), in which a pull-out type handle lock lever is provided at the rotary handle of the external operation handle device and pulled out at the OFF position (or ON position) to hang a padlock on the pulled out hand lock lever and lock the rotary handle at this position.

FIGS. 7 and 8 show a prior art structure of an external operation handle device with a door lock mechanism and a handle lock mechanism. In these drawings, the reference numeral 1 designates a circuit breaker, and the reference numeral 2 designates an external operation handle device disposed on the front surface of the circuit breaker 1. The circuit breaker 1 has functional parts disposed in a main housing 1*a*, including a fixed contact 1*b*, a movable contact 1*c*, a switching mechanism 1*d* of a toggle link type, a rotary handle 1*e* disposed at the top of the main housing 1*a*, and an over-current tripping device 1*f*.

An open-and-close operation of the circuit breaker 1 is well known. As a result of turning the rotary handle 1*e* from the ON position shown in FIG. 7 to the OFF position in the right, a toggle linkage of the switching mechanism 1*d* reverses, and the movable contact 1*c* receives an urging force from a switching spring and opens. When an over-current runs in the main circuit and the over-current trip device 1*f* works, the switching mechanism 1*d* trips. As a result, the switching mechanism 1*d* opens the movable contact 1*c* and interrupts the current automatically. In this trip operation, the rotary handle 1*e* moves according to the toggle link motion of the switching mechanism 1*d* to an intermediate position between the ON and OFF positions and stops at that position.

The external operation handle device 2 has, as described in detail in Patent Document 1, a rotary handle 4, a drive mechanism combining a turn base 5 and a slide base 6, and a handle cover 7 mounted on a mounting base 3.

The turn base (a crank arm) 5 of the external operation handle device 2 is connected to a shaft of the rotary handle 4 directly or through a latch. The slide base 6 is combined with the back surface of the mounting base 3, and guided and supported slidably in the open-and-close direction of the rotary handle 1*e* of the circuit breaker. In the central region of the plate of the slide base 6, an oblong hole is opened in the direction perpendicular to the sliding direction and engaged with a pin (a crank pin) 5*a* provided on the turn base 5 to link with the rotary handle 4. The slide base 6 has handle arms 6*a*, which are protrusions sandwiching the grip of the rotary handle 1*e* between the front and back sides. The rotary handle 1*e* is put between and engaged with the handle arms 6*a* in the installed state in the circuit breaker 1 (see FIG. 7). The handle cover 7 has a name plate 7*a* attached on the top surface thereof to indicate the positions (ON, TRIP, OFF, and OPEN) of the rotary handle 4.

In operation, turning the rotary handle 4 to an ON or OFF position, the rotational motion is converted into a linear motion through the turn base 5 and the slide base 6. Accordingly, the rotary handle 1*e* of the circuit breaker 1 is driven through the handle arms 6*a* of the slide base 6 to the ON or OFF position to close or open the main circuit contact points.

The external operation handle device 2 is equipped with a pull-out type handle lock lever 8 that is a handle lock device to lock the rotary handle 4 at an OFF position (or ON position), and a door lock lever 9 that is an interlock device with the board door.

FIG. 9 is an exploded perspective view showing the interlock between the external operation handle device 2 mounted on a circuit breaker 1 and a door panel of a switch board or the like. In FIG. 9, the reference numeral 10 designates a door panel of the switch board. The reference numeral 11 designates a decorative sheet attached on the front surface of the panel adjusting to a handle hole 10*a* opened in the door panel 10. The reference numeral 12*a* designates a latch formed at the inner periphery of a latch plate 12. The interlock is performed by engaging this latch 12*a* with a door lack lever 9 provided on the external operation handle device 2 to lock the door panel 10 at a closed position.

Next, a description is made as to a detailed structure and operation of the door lock mechanism with reference to FIG. 10. The door lock lever 9 is protruding sideward from a location between the handle cover 7 and the mounting base 3 of the external operation handle device 2 so as to oppose the latch 12*a* shown in FIG. 9. The door lock lever 9 is pivotally supported by a shaft (a release pin) 9*a* in the back surface side of the handle cover 7 as shown in FIG. 10. A cam portion of the door lock lever 9 projects to the path of movement of the protrusion 5*b* of the turn base 5 that is connected to the shaft 4*a* of the rotary handle 4. Below the door lock lever 9, a leaf spring 13 is provided to include a ridge portion for cramping and holding the door lock lever 9 at a locked or unlocked position.

The above-mentioned Patent Document 2 describes in detail the lock and unlock operations of the door panel 10 by the door lock lever 9. The door lock lever 9 normally stays at the position indicated by the two-dot chain line in FIG. 10 and is engaged with the latch 12*a* of the door panel so that the door panel 10 shown in FIG. 9 does not open and is locked at the closed position. To open the door panel 10 from this state, the rotary handle 4 is first turned to an OFF position (FIG. 8) to open the circuit breaker 1, then the rotary handle 4 is turned from this OFF position further to an OPEN position. As a result, the turn base 5 in FIG. 10 turns counterclockwise, and the protrusion 5*b* of the turn base 5 pushes the cam portion of the door lock lever 9. Accordingly, the door lock lever 9 swings clockwise about the shaft 9*a* and is released from the latch 12*a*. At the same time, the door lock lever 9 comes over passing the ridge 13*a* formed in the leaf spring 13 and held by itself at the unlocked position. At this position, interlock with the door panel 10 is released allowing the door to be freely opened.

When the rotary handle 4 is once manipulated to turn to the OPEN position and then released, the rotary handle 4 returns to the OFF position. When the opened door panel 10 is closed, a return tab (not shown), provided on the latch plate 12 in FIG. 9 and opposing the latch 12*a*, collides with the bottom edge of the door lock lever 9, pushing the lock lever back to the lock position. As a result, the door lock lever 9 comes over passing the ridge 13*a* of the leaf spring 13 and holds by itself at the lock position.

Another method for return operation of the door lock lever 9 is known (Patent Document 4: Japanese Unexamined Patent Application Publication No. H9-312119, for example), in which two mounting seats for the leaf spring 13 are provided and one of the seats for the leaf spring 13 is selected to change between a manual return and an automatic return.

Patent Document 3 describes in detail the function and operation of the handle lock lever 8 provided in the external operation handle device 2 of FIG. 8. At the position where the rotary handle 4 turned to the OFF (or ON) position, referring to FIGS. 11(*a*) and 11(*b*), a finger is put on the handle lock lever 8 and the handle lock lever 8 is pulled out towards the periphery of the rotary handle 4 (in the direction of the arrow in FIG. 11(*b*)), and after that, a padlock 14 is hung on the handle lock lever 8 to lock the rotary handle 4 at this position.

The external operation handle device having the conventional structure as described above, however, has the following problems about operation and performance of the door panel lock mechanism and handle lock mechanism thereof.

As described referring to FIG. 10, in order to hold the door lock lever 9, which is unlocked by turning the rotary handle 4 to the OPEN position, at the unlock position by itself, a ridge portion 13*a* of the leaf spring 13 is used in the conventional structure, the ridge portion being disposed opposing the cam portion of the door lock lever 9. In this arrangement, however, a range of adjustment is narrow for the door lock lever 9 to hold by itself at the lock/unlock position and readily affected by the configuration and dimensional accuracy of the leaf spring 13. Consequently, it may become unstable to hold the door panel by itself at the lock/unlock position due to deformation of the leaf spring 13 during a long term operation. In addition, adjustment between the door lock lever 9 and the latch 12*a* provided at the board side is delicately affected. Therefore, it takes a long time and efforts in the adjustment work at the job site in which the circuit breaker 1 is installed in a switch board to correctly set a relative position between the door lock lever 9 of the external operation handle device 2 and the latch plate 12 attached to the door panel 10 (FIG. 9). A solution for this problem is eagerly demanded by the users.

As for the handle lock lever 8 provided on the rotary handle 4, it is troublesome to put a finger on the lock lever 8, and pull out and push in whenever the lock and unlock operation is conducted.

The present invention has been made in view of the above problems, and an object of the invention is to solve the above problems and provide an external operation handle device with improvement in that a simple push operation can carry out interchange between pulling out and returning back of the handle lock lever, and the handle lock function of the handle lock lever is smartly utilized in lock/unlock operation of the door lock lever that performs interlock with the door panel of a switch board.

Further objects and advantages of the invention will be apparent from the following description of the invention.

SUMMARY OF THE INVENTION

To achieve the above object, the present invention provides an external operation handle device for conducting an open-and-close operation on a circuit breaker arranged inside a switch board or the like from outside of the board, the external operation handle device comprising, on a mounting base thereof, a rotary handle installing a handle lock lever of a pulling out type, a drive mechanism linking the rotary handle and a locker handle of the circuit breaker, and a door lock lever for interlocking between the rotary handle and the door of the board, the latter being unlocked at ON, OFF, and OPEN positions of the circuit breaker by operating the rotary handle.

The handle lock lever installed in the rotary handle is anchored and held at a pulled out position in the condition where the rotary handle is at the OPEN position to unlock the door of the board, and the door lock lever linked to the rotary handle is cramped and held at the unlock position in the condition where the rotary handle is at the OPEN position (first aspect of the present invention). Specifically, an external operation handle device has the following aspects of construction.

(1) The external operation handle device further comprises a cam mechanism of an alternate operation type. The cam mechanism is a device for manual change-over operation between pulling out and waiting positions of the handle lock lever at the ON, OFF and OPEN positions of the rotary handle, and the handle lock lever is anchored and held at the pulling out position through a first push operation. The handle lock lever is further returned to the waiting position through a second push operation in the alternate operation (second aspect of the present invention).

(2) In the external operation handle device of (1) above, the cam mechanism of an alternate operation type provided in the handle lock lever comprises a groove cam having steps and a cam pathway in the configuration of the heart, a control bar with a hook at one end thereof pushing a surface of the groove cam with steps and the other end fixed to the rotary handle, and an urging spring pushing the handle lock lever to a lock position, the groove cam having steps with a directional ratchet in the cam pathway in the configuration of the heart (third aspect of the present invention).

(3) In the external operation handle device of (2) above, the stepped groove cam is carved on a side surface of the handle lock lever (fourth aspect of the present invention).

(4) In the external operation handle device of (2) above, the control bar is a wire spring having a hook formed by bending one end of the wire spring to an L-shaped bend in an acute angle. A C-shaped bend is formed by bending a rear end and pushed into, and the C-shaped bend is held at a holder groove formed in the rotary handle (fifth aspect of the present invention).

In the external operation handle device having the above-described construction, by pushing the handle lock lever manually after turning the rotary handle from an OFF position to an OPEN position, in addition to ON and OFF positions, the handle lock lever is anchored and held at an OPEN pulled out position by the alternate operation of the cam mechanism. The lock lever returns to the original waiting position by pushing the handle lock lever again from this state.

Consequently, when the interlock with the door panel of the switch board is unlocked to open the door panel, after turning the rotary handle to the OPEN position and moving the door lock lever to the unlock position, and by pushing the handle lock lever, the rotary handle is anchored and held at this OPEN position, and the door lock lever linked to the rotary handle is cramped and held at the unlock position. If the handle is released from a hand in this state, the door lock lever still stays at the unlock position as before without return motions. Therefore, the board panel can be opened safely.

As the cam mechanism of an alternate operation type provided as a device for changing-over between pulling out and return positions of the handle lock lever, the change-over of the handle lever can be carried out by a simple push operation. Therefore, manipulation of the handle lock lever is made easier in the course of locking operations at ON, OFF, and OPEN positions.

BRIEF DESCRIPTION OF THE DRAWINGS

FIGS. 3(*a*) and 3(*b*) show a detailed structure of the cam mechanism in FIG. 1, in which FIG. 3(*a*) is a plan view showing a schematic of a groove cam with steps and FIG. 3(*b*) is a developed sectional view of the groove cam along the path on the cam shown in FIG. 3(*a*);

DETAILED DESCRIPTION OF PREFERRED EMBODIMENTS

Figure 1:
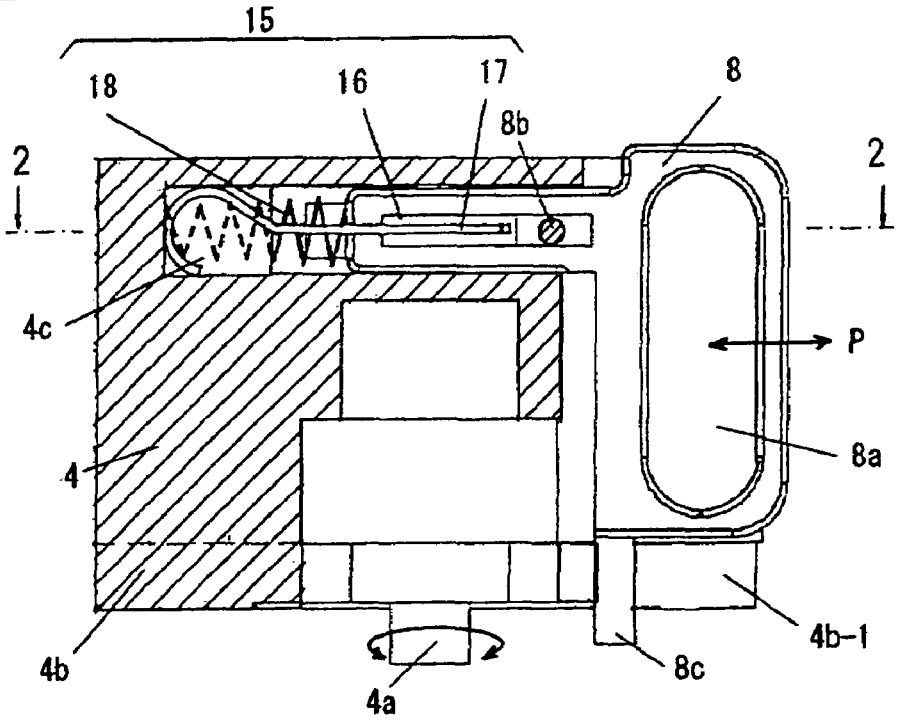
FIG. 1 is a side sectional view showing a structure of a rotary handle of an external operation handle device in an embodiment according to the invention.
Figure 2:
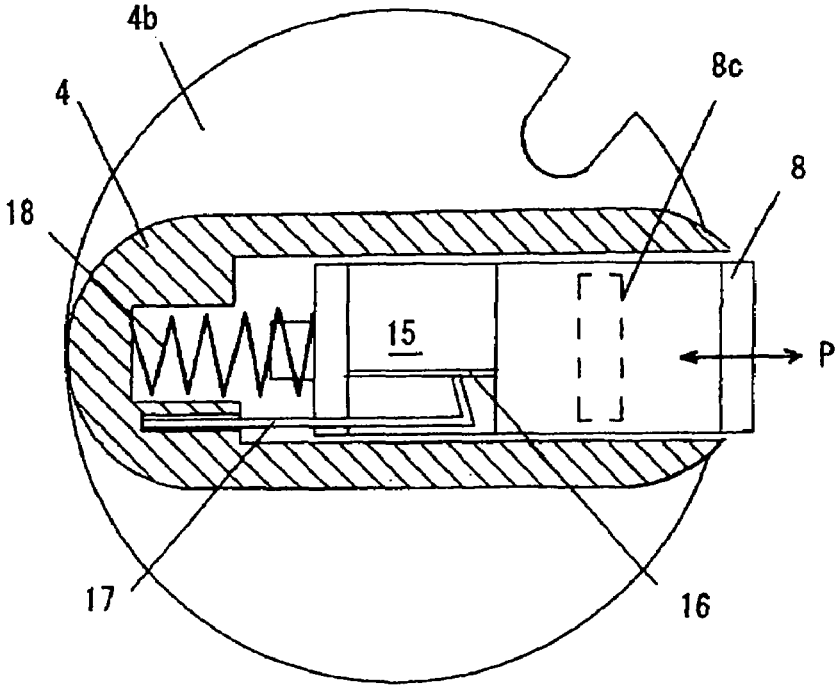
FIG. 2 is a sectional view taken along line 2-2 in FIG. 1.
Figure 4:
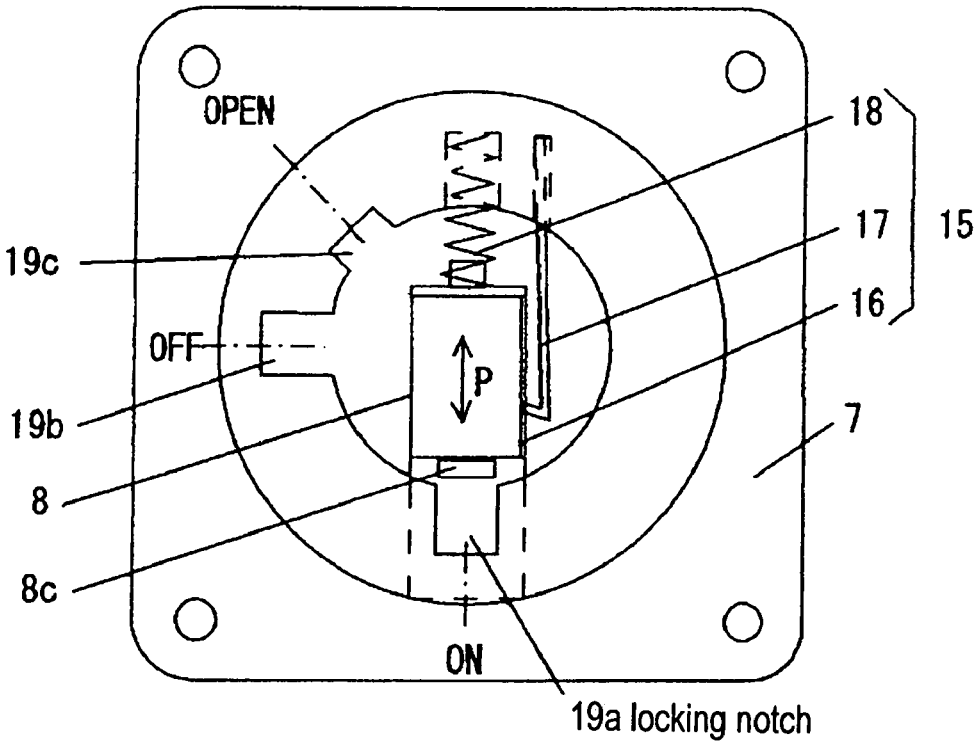
FIG. 4 shows locking notches formed in an inner periphery of an opening in a handle cover corresponding to ON, OFF and OPEN positions of the rotary handle, and used for anchoring and holding a handle lock lever.
Figure 5:
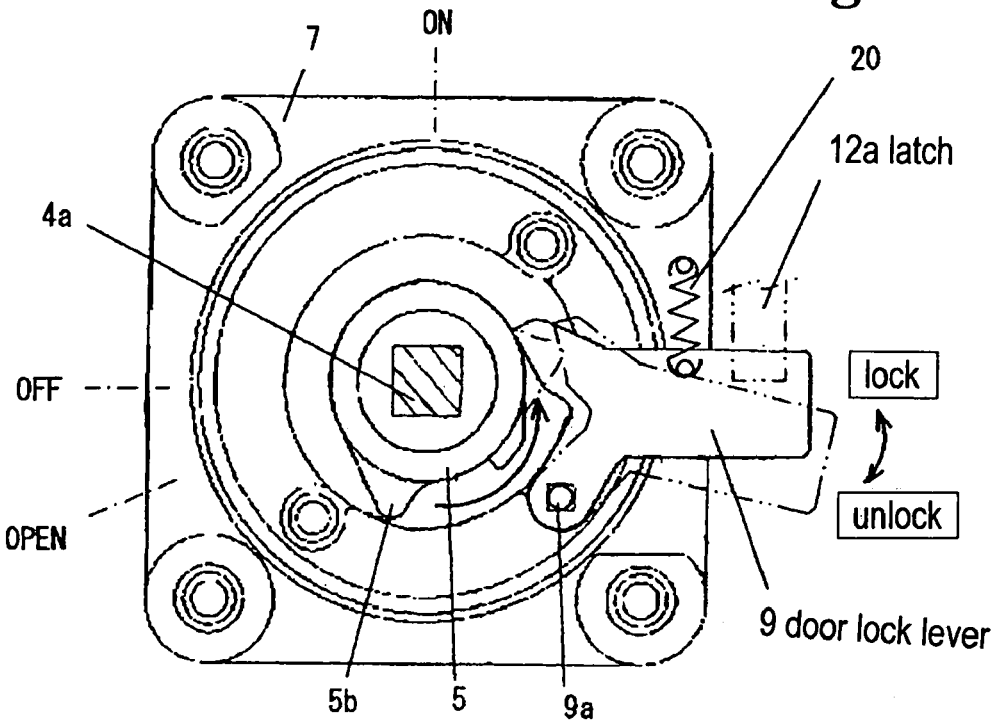
FIG. 5 shows an arrangement and construction of a door lock lever provided in an external operation handle device of an embodiment according to the invention.
Figure 6:
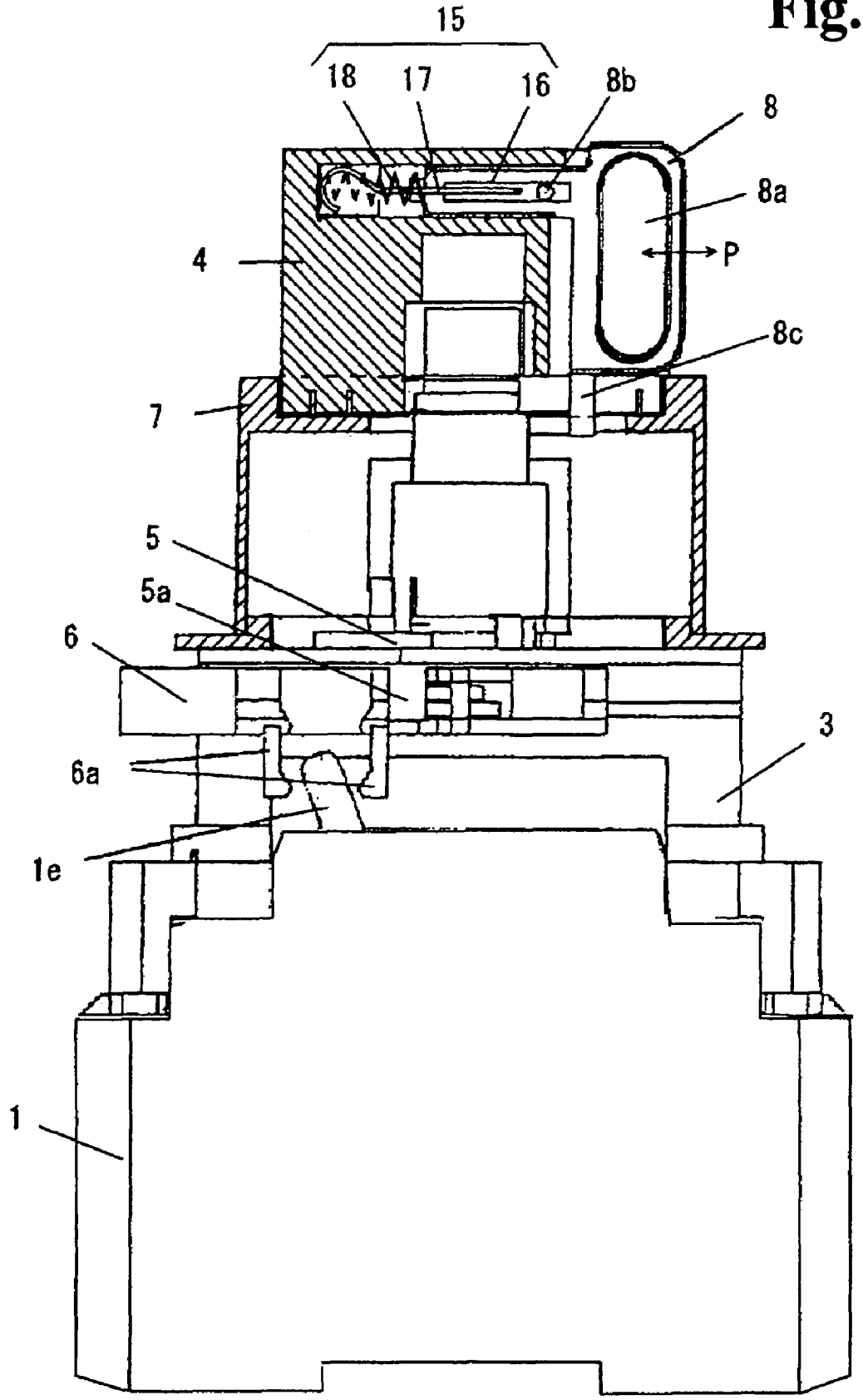
FIG. 6 shows an overall structure including an external operation handle device of an embodiment according to the invention combined with a circuit breaker.

Some preferred embodiments according to the present invention will be described with reference to FIGS. 1 through 6, in which FIGS. 1 and 2 show a structure of the rotary handle; FIGS. 3(*a*) and 3(*b*) show a development of an alternate operation type cam mechanism provided in a handle lock lever; FIG. 4 is a plan view of a handle cover; FIG. 5 shows a structure of a door lock lever provided on the back surface of the handle cover; and FIG. 6 shows an overall structure of an external operation handle device combined with a circuit breaker. The same members in the embodiment are given the same symbols as in FIGS. 7 through 10 and description is omitted.

Figure 7:
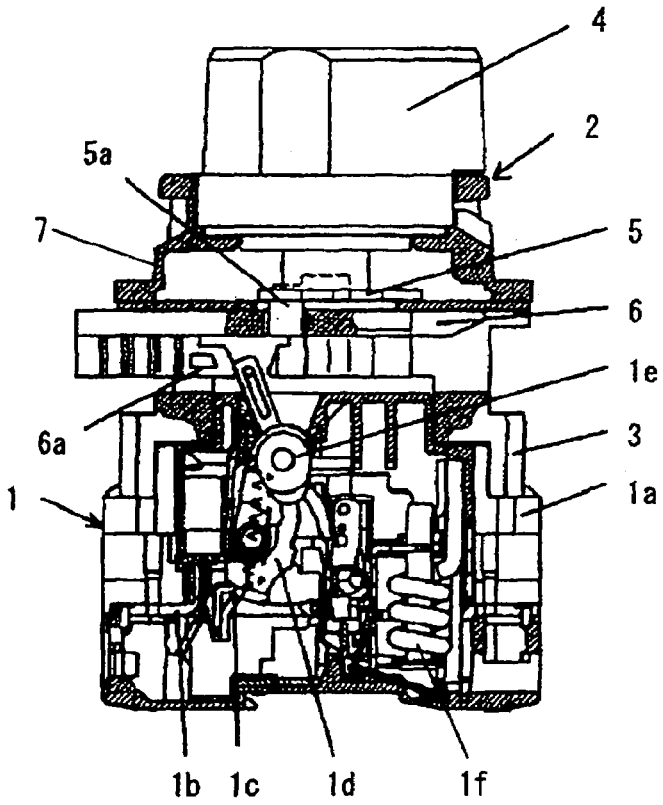
Fig. 7 Prior Art
FIG. 7 shows an external operation handle device having a conventional structure combined with a circuit breaker.
Figure 8:
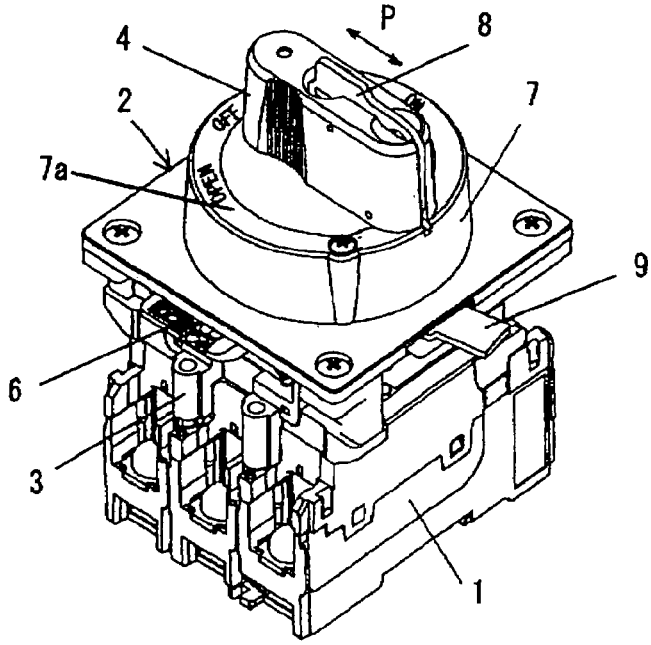
Fig. 8 Prior Art
FIG. 8 is a perspective view corresponding to FIG. 7

The external operation handle device shown in FIG. 6 has basically a similar structure to the conventional structure as shown in FIGS. 7 and 8. Nevertheless, the rotary handle 4 of the embodiment shown in FIG. 6 comprises a newly added cam mechanism 15 of an alternate operation type, details of which will be described hereinafter. Further, in an inner periphery of an opening on a top surface of a handle cover 7 mounting the rotary handle 4 (see FIG. 4), locking notches 19*a*, 19*b*, and 19*c* are formed corresponding to OPEN position for unlocking a door panel as well as ON and OFF positions of the rotary handle 4, the lock notches being provided for anchoring and holding a handle lock lever 8 at the respective pull out positions. The following describes details of the structure and operation of these parts.

Firstly, referring to FIG. 1 and FIG. 2, the grip portion of the rotary handle 4 includes a handle lock lever 8 that can be pulled out and pushed in, in the direction indicated by the allow P. The handle lock lever 8 is guided and supported through a guide pin 8*b* on the rotary handle 4. The handle lock lever 8 has a hole 8*a* for hanging a padlock at the outer end and an anchor rib 8*c* formed at the bottom of the handle lock lever 8 for anchoring and holding the handle lock lever 8 on the handle cover 7. The anchor rib 8*c* projects downward through a clearance groove 4*b*-1 in the radial direction cut in a disk-shaped flange part 4*b* of the rotary handle 4.

A cam mechanism 15 of an alternate operation type is constructed in the rotary handle 4 as described hereinafter. The cam mechanism 15 consists of a groove cam with steps 16 carved on the side face of the handle lock lever 8, a control bar 17 having an L-shaped bend at its tip to slide on the cam surface of the groove cam 16, and an urging spring 18 (a compression spring) for pushing the handle lock lever 8 towards the pull-out direction. The control bar 17 is a wire spring having an L-shaped bend (in an acute angle) at one end thereof and a C-shaped bend at the other end thereof, the latter being pushed into and held at a holder groove 4*c* in a slit shape formed in the rotary handle 4.

FIGS. 3(*a*) and 3(*b*) show a detailed configuration of the groove cam 16 with steps. The groove cam 16 has a cam pathway with a heart shape starting at a part A, through parts B, C, D, E, F, G, and H, and returning to the part A, as shown in FIG. 3(*a*). At the locations of corners along the pathway, formed are steps B, D, F, and H that have a ratchet shape and exhibit unidirectional (backstop) property.

When the handle lock lever 8, which includes the cam mechanism 15 having the above-described construction, is stored in the rotary handle 4, the hook of the control bar 17 stays at E in the cam pathway in FIGS. 3(*a*) and 3(*b*); this position is referred to as a waiting position P1. From this state, when the outer end of the handle lock lever 8 is pushed by a finger towards the interior of the rotary handle 4 (first push operation), the hook of the control bar 17 slides beyond the slope of the step F moving into position G. (Reverse motion from E to C is obstructed by the step D.) Leaving the finger off the handle lock lever 8 at this state, the lock lever slides towards the pulling out direction receiving a spring force of the urging spring 18. During this sliding process, the hook of the control bar 17 moves from the position G and slides beyond the slope of the step H moving into position A, which is referred to as a lock position P2. In this state, the outer end of the handle lock lever 8 is projecting out from the periphery of the rotary handle 4.

From this state, when the handle lock lever 8 is pushed inward again (second push operation), the hook of the control lever 17 slides beyond the slope of the step B moving into position C. (Reverse motion from A to G is obstructed by the step H.) Leaving the finger off the handle lock lever 8, the lock lever is pushed back by receiving the spring force of the urging spring 18. In this moving back process, the hook of the control lever 17 slides from the position C, over the slope of the step D, and back to the position E (the waiting position P1). Thus, the handle lock lever 8 returns to the initial waiting position.

Figure 11A:
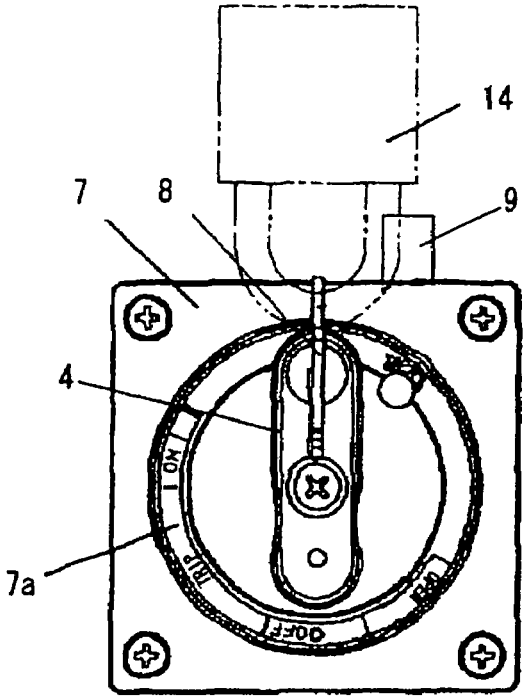
Fig. 11(a) Prior Art
FIGS. 11(*a*) and 11(*b*) show a state of handle lock in which a handle lock lever is pulled out from the external operation handle device of FIG. 7 and a padlock is hung on the handle lock lever, in which FIG. 11(*a*) is a plan view and FIG. 11(*b*) is a side view.
Figure 11B:
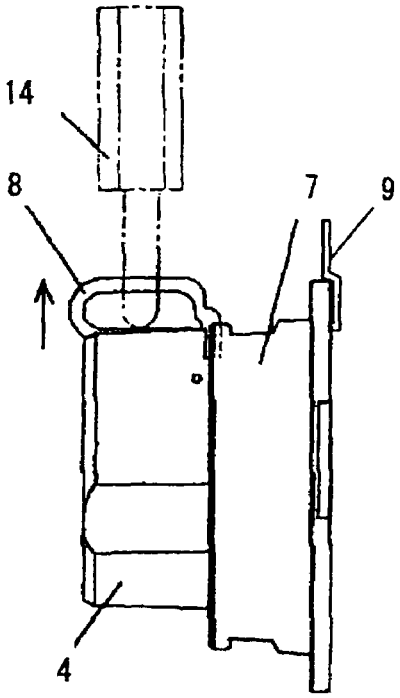
Fig. 11(b) Prior Art

Relating to the handle lock mechanism described previously, locking notches are formed on the top surface of the handle cover, which receives and supports the rotary handle 4, as describe below. Referring to FIG. 4, locking notches 19*a*, 19*b*, and 19*c* are formed by partially cutting off the inner periphery of an opening on the top surface of the handle cover 7 corresponding to the ON, OFF, and OPEN positions, respectively, of the rotary handle 4, for anchoring and holding (inhibiting rotational motion) the anchor rib 8*c* of the handle lock lever 8 projecting out of the rotary handle 4. The depths of the locking notches 19*a* and 19*b* corresponding to the ON and OFF positions are large because a padlock is hung on the handle lock lever 8 at the ON and OFF positions of the rotary handle as mentioned referring to FIG. 11. At the OPEN position, on the other hand, a padlock does not need to be hung on the handle lock lever 8, so the locking notch 19*c* is designed to be shallow.

Figure 10:
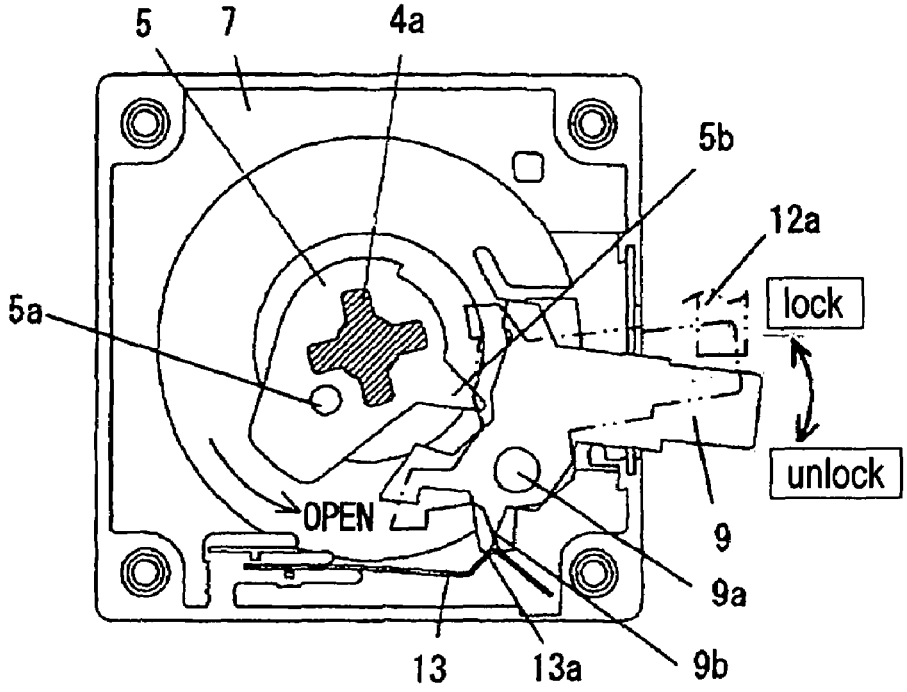
Fig. 10 Prior Art
FIG. 10 shows an arrangement and construction of a door lock lever provided in the external operation handle device of FIG. 7.

In a door lock mechanism shown in FIG. 5 of the embodiment, a door lock lever 9 is pivotally supported by a support pin 9*a* like the conventional structure of FIG. 10 and the lever cam portion of the door lock lever 9 is arranged to project into the moving path of a protrusion 5*b* of the turn base 5 connected to the handle shaft 4*a*. The door lock lever 9 is not provided with a leaf spring 13 for self supporting in the conventional structure (see FIG. 10). Instead, an urging spring 20, a tension coil spring, is provided to urge the door lock lever 9 towards the locking direction.

The following describes an operation of an external operation handle device 2 having the above-described construction. To lock the rotary handle 4 at the ON or OFF position, after turning the rotary handle 4 to the ON or OFF position, the handle lock lever 8 is touched by a finger at its end and once pushed into the interior of the rotary handle 4, and then released (first push operation). Through this operation, the alternate operation of the cam mechanism 15 as described earlier referring to FIG. 3 moves the handle lock lever 8 to the pulled out position and at the same time, the anchor rib 8*c* engages with the locking notch 19*a* or 19*b* formed in the handle cover 7 to hold the handle lock lever 8 at this position inhibiting its rotation. In this state, a padlock 14 is hung on the handle lock lever 8 to lock the rotary handle 4 at the ON or OFF position (see FIG. 11). To release lock of the rotary handle 4, after removing the padlock 14, the handle lock lever 8 is pushed at its end towards the interior of the rotary handle 4 and released (second push operation). Through this operation, the handle lock lever 8 returns to the waiting position and is stored in the rotary handle 4 allowing the rotary handle to be turned.

Figure 9:
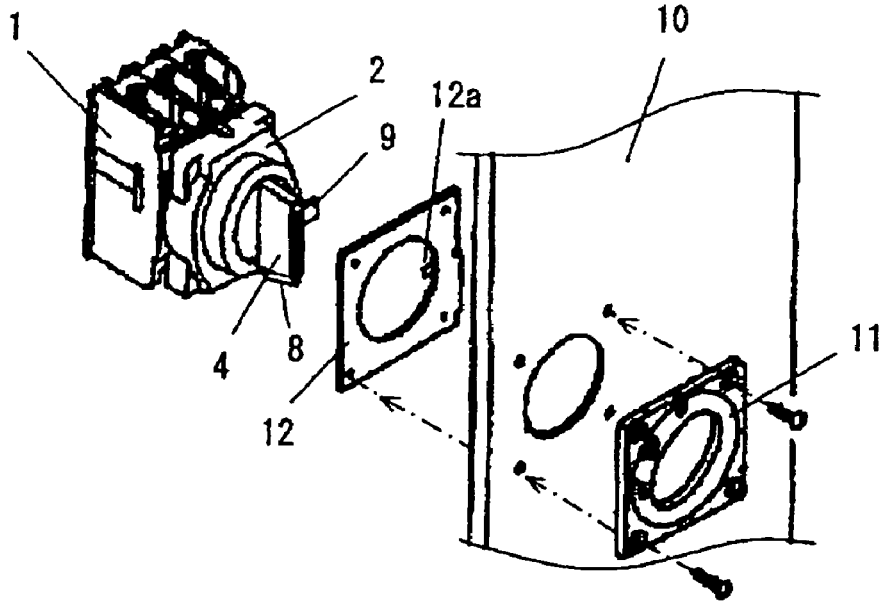
Fig. 9 Prior Art
FIG. 9 is an exploded perspective view showing an interlock structure between the external operation handle device of FIG. 7 and a door of a switch board.

In order to open the door panel 10 of the switch board as shown in FIG. 9, the rotary handle 4 of the external operation handle device 2 is first turned to the OFF position to open the circuit breaker 1. Subsequently, the rotary handle 4 is further turned from the OFF position to the OPEN position. Through this operation, the protrusion 5*b* of the turn base 5 in FIG. 5 moves counterclockwise and pushes the cam portion of the door lock lever 9. As a result, the door lock lever 9 rotates clockwise about the support pin 9*a* and is released from the latch 12*a* to unlock the door panel. When the rotary handle 4 is turned to the OPEN position, the anchor rib 8*c* of the handle lock lever 9 comes to face the locking notch 19*c* shown in FIG. 4. Pushing the handle lock lever 8 at this OPEN position corresponding to the unlock operation for the door panel, the anchor rib 8*c* engages with the locking notch 19*c* through the alternate operation of the cam mechanism 15 and the handle lock lever 8 is anchored and held at this position. In this condition, the interlock has been released between the external operation handle device 2 and the door of the switch board, and the door lock lever 9 is held at the unlock position by itself without touching the rotary handle 4, allowing the door panel 10 to be opened safely.

In order to close and lock the door of the switch board, the opened door panel 10 is returned to the closed position and subsequently the handle lock lever 8 is pushed to return to the waiting position. Then, the rotary handle 4 is moved back from the OPEN position to the OFF position. Through this operation, the door lock lever 9 is released from the self-holding condition at the unlock position and returns to the locked position receiving a spring force of the urging spring 20, locking door of the switch board at the closed position.

The disclosure of Japanese Patent Application No. 2006-255923 filed on Sep. 21, 2006 is incorporated as a reference.

While the invention has been explained with reference to the specific embodiments of the invention, the explanation is illustrative and the invention is limited only by the appended claims

What is claimed is:

1. An external operation handle device for conducting open and close operations on a circuit breaker with a locker handle, comprising:

a rotary handle equipped with a handle lock lever, a drive mechanism for linking the rotary handle and the locker handle of the circuit breaker, and a door lock lever for interlocking between the rotary handle and a door of the board so that by operating the rotary handle, the circuit breaker can be turned to an ON or OFF position, and the door is unlocked at an OPEN position, wherein the handle lock lever is slidably disposed on the rotary handle to be anchored and held at a pulled out position in a condition where the rotary handle at the OPEN position unlocks the door of the board, and the door lock lever linked to the rotary handle is cramped and held at the unlock position in a condition where the rotary handle is at the OPEN position.

2. An external operation handle device according to claim 1, further comprising a cam mechanism with an alternate operation system for manually changing pulled out and waiting positions of the handle lock lever at the ON, OFF and OPEN positions of the rotary handle, said alternate operation system actuating the handle lock lever to be anchored and held at the pulled out position through a first push operation and returned to a waiting position through a second push operation.

3. An external operation handle device according to claim 2, wherein the cam mechanism of the alternate operation system comprises a groove cam having a cam pathway in a heart shape and steps with a ratchet in a direction of the cam pathway, a control bar having a hook at one end for pushing a surface of the groove cam with the steps and the other end fixed to the rotary handle, and an urging spring pushing the handle lock lever to a lock position.

4. An external operation handle device according to claim 3, wherein the groove cam with the steps is provided on a side surface of the handle lock lever.

5. An external operation handle device according to claim 3, wherein the control bar is a wire spring having a hook at a tip end in an acute angle, and a C-shaped portion at a rear end, said C-shaped portion being pushed into and held at a holder groove formed in the rotary handle.

* * * * *